US005967888A

United States Patent [19]

Lawhun

[11] Patent Number: 5,967,888

[45] Date of Patent: Oct. 19, 1999

[54] FISH HOOK SHARPENING HOLDER AND METHOD

[76] Inventor: Samuel R. Lawhun, 317 Riviera Dr., Debary, Fla. 32713

[21] Appl. No.: 08/888,338

[22] Filed: Jul. 2, 1997

[51] Int. Cl.[6] ..... B24B 1/00

[52] U.S. Cl. ..... 451/367; 269/243

[58] Field of Search ..... 451/45, 367, 382; 269/243, 239, 257

[56] References Cited

U.S. PATENT DOCUMENTS

| | | | |
|---|---|---|---|
| 2,542,472 | 2/1951 | Brinkley | 76/86 |
| 2,766,644 | 10/1956 | Marks | 76/88 |
| 3,706,466 | 12/1972 | Landry et al. | 289/17 |
| 4,216,948 | 8/1980 | Carter | 269/71 |
| 4,322,065 | 3/1982 | Doiron | 269/254 |
| 4,508,328 | 4/1985 | Kojima | 269/236 |
| 4,530,188 | 7/1985 | Graves | 51/214 |
| 4,706,948 | 11/1987 | Kroecher | 269/34 |
| 5,131,780 | 7/1992 | Love | 269/249 |
| 5,172,523 | 12/1992 | Kadlec | 51/204 |
| 5,287,661 | 2/1994 | Benner | 51/205 |
| 5,383,307 | 1/1995 | Anderson | 451/545 |

*Primary Examiner*—Timothy V. Eley
*Assistant Examiner*—Benjamin M. Halpern
*Attorney, Agent, or Firm*—John V. Stewart

[57] ABSTRACT

A clamp for holding a fish hook for sharpening, comprising a flat horizontal base (1), a first vertical plate (2) fixed to the base, and a second vertical plate (3) mounted against the first vertical plate by two bolts (7) with wing nuts (8). The base and vertical plates are preferably made of plastic. A horizontal groove (5) is cut in both vertical plates to receive the eye (9*a*) of a fish hook (9), allowing the shaft of the hook to fully contact the facing surfaces of the vertical plates. An optional second groove (6) in both plates receives the eyes of smaller hooks, so that both large and small hooks are automatically held at a convenient angle for sharpening. A sharpening stone (10) with a V-shaped channel (11) is preferably attached to the base with Velcro.

2 Claims, 3 Drawing Sheets

FISH HOOK SHARPENING HOLDER AND METHOD

BACKGROUND OF THE INVENTION

1. Field of the Invention

This invention is in the field of clamps for holding fish hooks for sharpening.

2. Description of Prior Art

Fish hooks become dull periodically during use. They are easily sharpened with a stone having a V-shaped groove, but they are not easy to hold, especially when slippery. Pliers can be used to hold hooks, but pliers occupy one hand, requiring coordination of two hands and arms for sharpening. This is a special disadvantage in a rocking boat, where one hand is needed to steady the individual.

Several fish hook clamps have been patented, mainly for fly tying. Examples include U.S. Pat. Nos. 3,706,466, 4,216,948, 4,322,065, and 4,508,328. However, these are complicated (many parts and adjustments), unstable (mounted adjustably on columns), non-durable (easily bent), and hazardous (sharp protrusions). Fly tying clamps do not hold a hook in ideal position for sharpening, since they are designed to hold the hook by the curved end, with the shaft protruding for fly tying.

Several fish hook sharpeners have been patented, such as U.S. Pat. Nos. 2,766,644, 5,172,523, and 5,287,661. However, these require the user to hold the fish hook by hand, or with pliers, and the sharpener in the other hand, which is difficult and hazardous.

SUMMARY OF THE INVENTION

What is needed is a fish hook clamp that is simple, sturdy, safe, holds fish hooks of a wide range of sizes at a convenient angle for sharpening with a stone, and can be held in the hand or attached to a surface to leave one hand free. A further object of the invention is a method for quickly inserting and removing fish hooks in the clamp without adjustment.

These objects are achieved via a clamp comprising a flat horizontal base (1), a first vertical plate (2) fixed to the base, and a second vertical plate (3) mounted against the first vertical plate by two bolts (7) with wing nuts (8). The base and vertical plates are preferably made of plastic. A horizontal groove (5) is cut in both vertical plates to receive the eye **(9*a*) of a fish hook (9), allowing the shaft of the hook to fully contact the facing surfaces of the vertical plates. An optional second groove (6) in both plates receives the eyes of smaller hooks, so that both large and small hooks are automatically held at a convenient angle for sharpening. A sharpening stone (10) with a V-shaped channel (11)** is preferably attached to the base with Velcro.

REFERENCE NUMERALS

Figure 1:
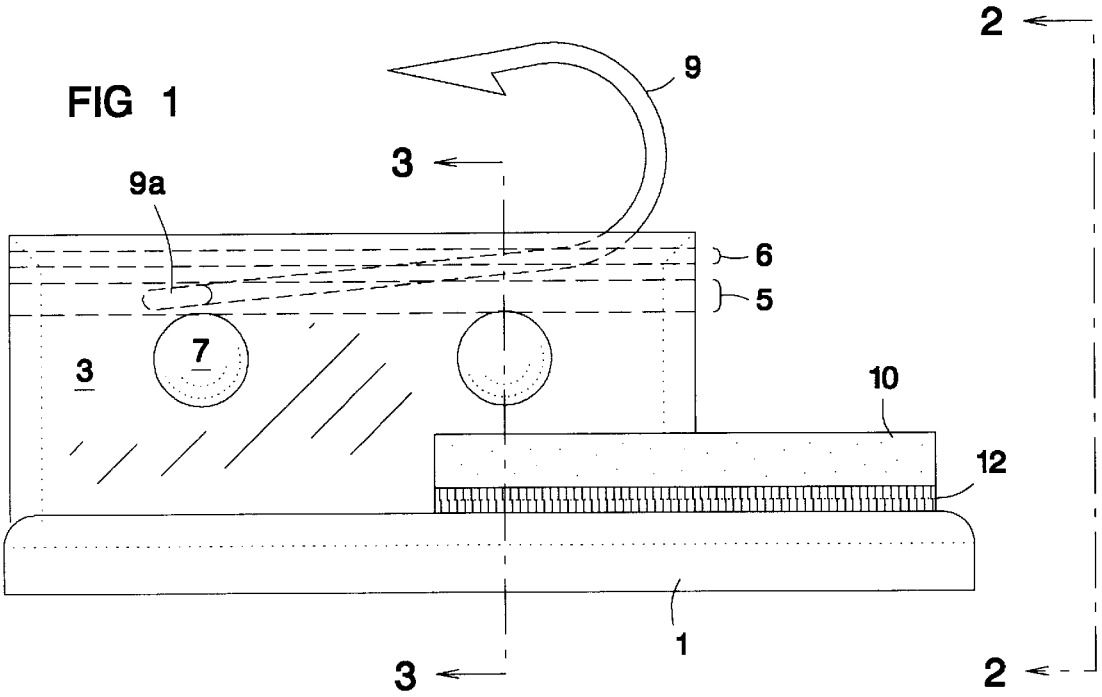
FIG. 1 is a front view of the device holding a large fish hook.

1. Base
2. Fixed plate of clamp
3. Movable plate of clamp
4. Hole for clamping bolt
5. Groove for eye of large fish hook
6. Groove for eye of small fish hook (optional)
7. Clamping bolt
8. Wing nut
9. Fish hook
**9*a***. Eye on end of shaft of fish hook
10. Sharpening stone
11. Groove in sharpening stone
12. Hook-and-loop fastening tape, such as Velcro,
13. Attachment screw
14. Throat of clamping bolt

DESCRIPTION OF THE PREFERRED EMBODIMENTS

Figure 2:
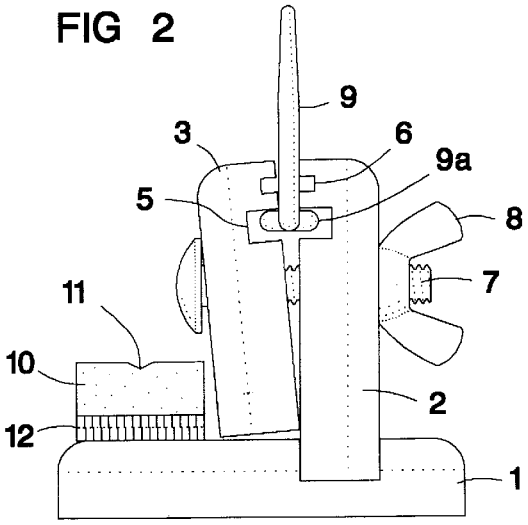
FIG. 2 is a side view taken on line 2—2 of FIG. 1.
Figure 3:
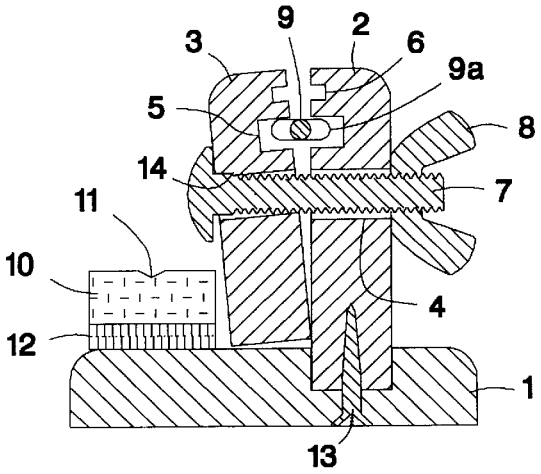
FIG. 3 is a side sectional view taken on line 3—3 of FIG. 1.

As shown in FIGS. 1–3, the device has a flat horizontal base (1) holding a flat vertical plate (2). A second plate (3) is mounted against the fixed plate (2) by clamping bolts (7). A horizontal groove (5) in the vertical plates provides space for the eye of a fish hook. This prevents the eye from holding the clamp plates apart. The shaft of the hook fully contacts the facing surfaces of plates. The clamping bolts (7) are preferably carriage bolts, which have a smooth head and a square throat (14). The square throat prevents the bolt from turning in the hole in the movable plate (3). The nuts are preferably wing nuts, as shown. The device may be embodied with only a single clamp bolt, if desired. The base and vertical plates are preferably made of semi-rigid plastic. A sharpening stone (10) with a groove (11) is preferably attached to the clamp base (1) with Velcro strips, for easy removal and replacement.

Figure 5:
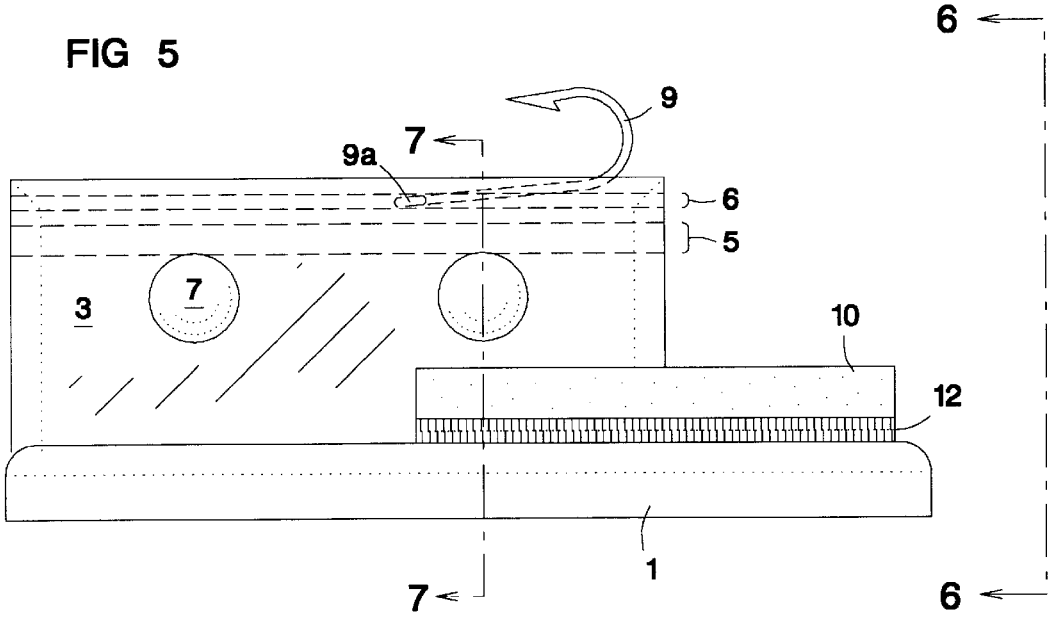
FIG. 5 is a front view of the device holding a small fish hook in a second groove (6).
Figure 6:
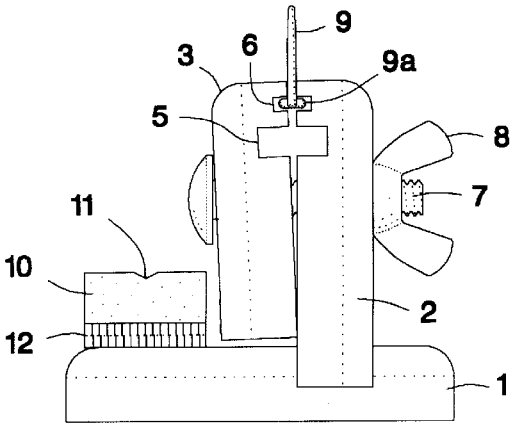
FIG. 6 is a side view taken on line 6—6 of FIG. 5.
Figure 7:
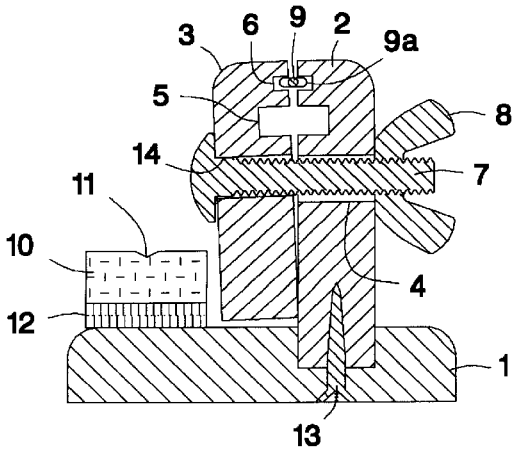
FIG. 7 is a side sectional view taken on line 7—7 of FIG. 5.

Preferably, a second horizontal groove (6) is provided in the clamp plates for receiving the eyes of small hooks. This provides automatic positioning of clamping angle for both small and large hooks. If a smaller groove is not provided, the user may hold the eye of a hook against the top of the single groove while clamping, to minimize the angle of the hook. However, a second groove eliminates the need for this effort. FIGS. 5–7 show the device holding a small fish hook in with its eye **(9*a*) in a smaller groove (6)** in the plates.

The user places a fish hook in the clamp with the eye of the hook in either the large groove (5) or small groove (6), depending on the size of the hook. The wing nuts are then tightened to clamp the hook between the vertical plates. The sharpening stone is removed from the base, and used to sharpen the point of the hook.

Figure 4:
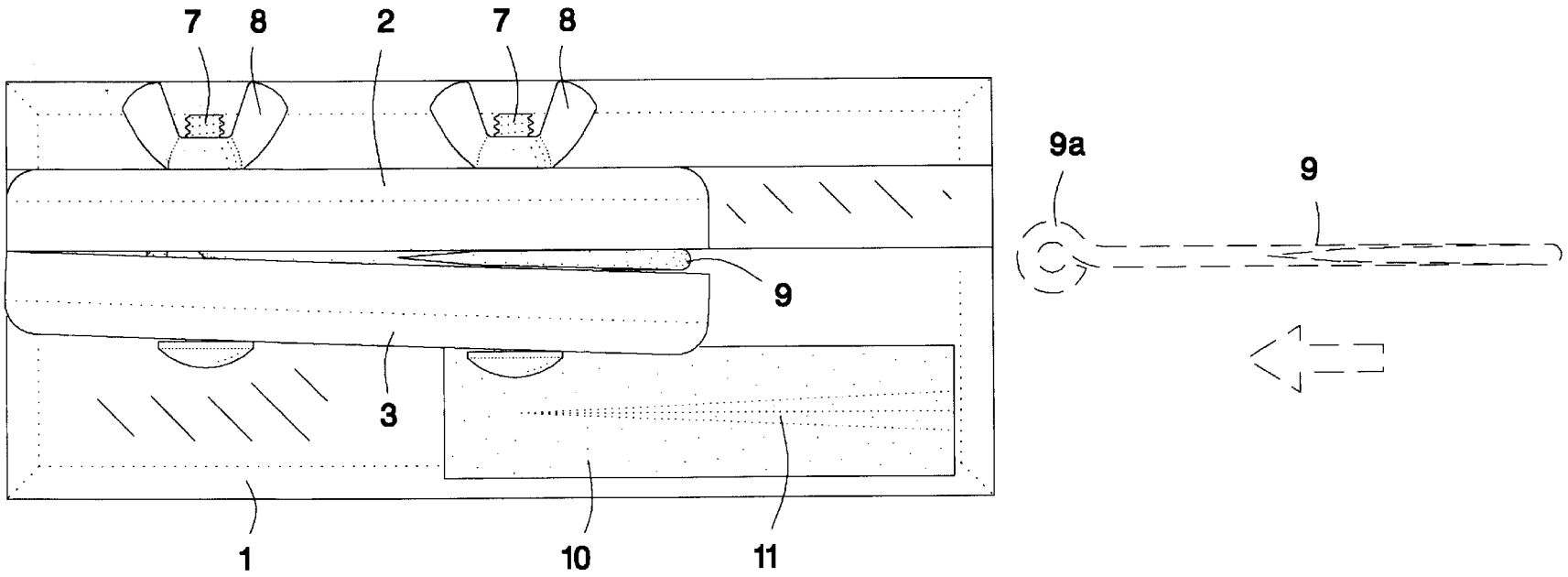
FIG. 4 is a top view of the device from FIG. 1.

For sharpening a series of hooks of similar size, the clamp can be set with moderate force on a first hook. After sharpening, the hook can be pulled horizontally out of the clamp without loosening the nuts, and the next hook can be pushed horizontally into the clamp (FIG. 4), wedging it between the clamp plates without tightening the nuts. This is possible because the clamp plates diverge to form a wedge-shaped space between them (FIG. 4). The preferred plastic material of the plates is semi-elastic, allowing smooth wedging and removal of hooks in this manner. This offers a fast method of sharpening a set of hooks using only one hand. The clamp can remain in position for receiving a wide range of hooks using this method, by closing one end, and leaving the other end parted enough to receive the largest hook to be sharpened.

A non-adjustable embodiment of the invention can be offered without clamp bolts, in which the vertical plates are permanently positioned with a wedge-shaped space between them. The separation of the plates at the widest part should be large enough to receive the largest hook to be sharpened. However, the adjustable version shown in all the drawings herein is preferred, since it is easier to produce a tight grip on the hooks by operating the wing nuts.

Although the present invention has been described herein with respect to preferred embodiments, it will be understood that the foregoing description is intended to be illustrative, not restrictive. Modifications of the present invention will occur to those skilled in the art. All such modifications which fall within the scope of the appended claims are intended to be within the scope and spirit of the present invention.

I claim:

1. A fish hook holder comprising:

first and second clamping plates facing each other at a facing surface on each of the plates;

a groove in running mutually across the facing surfaces of the clamping plates;

the groove having generally parallel upper and lower surfaces in each of the plates;

two clamping screws passing through both plates for drawing the facing surfaces together;

a base having an upper surface;

a groove in the upper surface of the base; and the first clamping plate having a lower edge mounted in the groove in the base.

2. A fish hook sharpening holder comprising:

a generally rectangular base having an upper surface with a longitudinal groove;

a generally rectangular first plate mounted in the groove of the base;

a second plate mounted against the first plate by two clamp bolts;

each of the clamp bolts having a nut that is manually operable without tools;

each of the two plates having a surface that faces the other plate;

a first groove in each of the facing surfaces of the two plates, the two first grooves facing each other and dimensioned for receiving the eye of a fish hook; and a sharpening stone having a surface with a V-shaped groove, the sharpening stone removably attached to the base;

whereby a fish hook of the type having a curved shaft with a point on one end and an eye on the other end can be placed between the two plates with the eye in the facing grooves, the shaft contacted by the facing surfaces of the plates, and the nuts can be tightened to clamp the hook firmly between the two plates for sharpening.

* * * * *